US006442781B1

(12) United States Patent
Chen

(10) Patent No.: US 6,442,781 B1
(45) Date of Patent: Sep. 3, 2002

(54) PLANE SAW ASSEMBLY

(76) Inventor: Mark Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/881,186

(22) Filed: Jun. 12, 2001

(51) Int. Cl.[7] ..... B25F 1/00
(52) U.S. Cl. ..... 7/148; 7/158; 30/514
(58) Field of Search ..... 30/514, 500; 7/148, 7/158; 83/835

(56) References Cited

U.S. PATENT DOCUMENTS 2,437,668 A * 3/1948 Adams ..... 83/835 X
6,357,122 B2 * 3/2002 Bachita ..... 30/514 X

* cited by examiner

*Primary Examiner*—Douglas D. Watts

(57) ABSTRACT

A plane saw assembly has a handle, a nut inserted in the handle, a hollow plane saw connected to the handle, a hollow plug inserted in the hollow plane saw and the handle, a bolt inserted in the hollow plug, a collar receiving the hollow plane saw, and a drill device having a threaded post inserted in the collar. The hollow plane saw has an end slot, a large number of plane blades, and a large number of through holes matching the plane blades. Each of the plane blades has a cutting edge.

4 Claims, 13 Drawing Sheets

PLANE SAW ASSEMBLY

BACKGROUND OF THE INVENTION

The present invention relates to a plane saw assembly. More particularly, the present invention relates to a plane saw assembly which has a hollow plane saw and a drill device.

Referring to FIG. 1, a conventional saw has a blade 1 which has a bifurcate toe 2. The bifurcate toe 2 pierces a hole on a wooden article or a plastics article (not shown in the figure). However, it is difficult to pierce the hole with the bifurcate toe 2. Furthermore, the blade 1 cannot pass through the hole of the wooden article or the plastics article. Since the cutting direction of the blade 1 cannot be changed easily, a round hole or a square hole cannot be formed.

SUMMARY OF THE INVENTION

An object of the present invention is to provide a plane saw assembly which has a hollow plane saw and a drill device and an inner diameter of the hollow plane saw is smaller than an inner diameter of the drill device so that the hollow plane saw can pass through a hole drilled by the drill device easily.

Another object of the present invention is to provide a plane saw assembly which can change a cutting direction easily.

Another object of the present invention is to provide a plane saw assembly which can be operated very fast.

Accordingly, a plane saw assembly comprises a handle, a nut, a hollow plane saw, a hollow plug, a bolt, a collar, and a drill device. The hollow plane saw has a large number of plane blades, a large number of through holes communicating with the plane blades, a first end, a second end, and an end slot formed on the second end of the hollow plane saw. Each of the plane blades has a cutting edge. The handle has an end socket receiving the first end of the hollow plane saw, an inner through aperture communicating with the end socket, and an inner chamber communicating with the inner through aperture. The nut is inserted in the inner chamber. The hollow plug has a center hole and a taper body. The bolt has an outer threaded portion. The collar has a threaded hole and an inner block. The drill device has a bit and a threaded post inserted in the threaded hole of the collar. The hollow plug is inserted in the first end of the hollow plane saw. The bolt is inserted through the hollow plug and the inner through aperture of the handle and engaged with the inner thread of the nut. The second end of the hollow plane saw is inserted in the collar. The inner block is inserted in the end slot of the hollow plane saw.

DETAILED DESCRIPTION OF THE INVENTION

Figure 1:
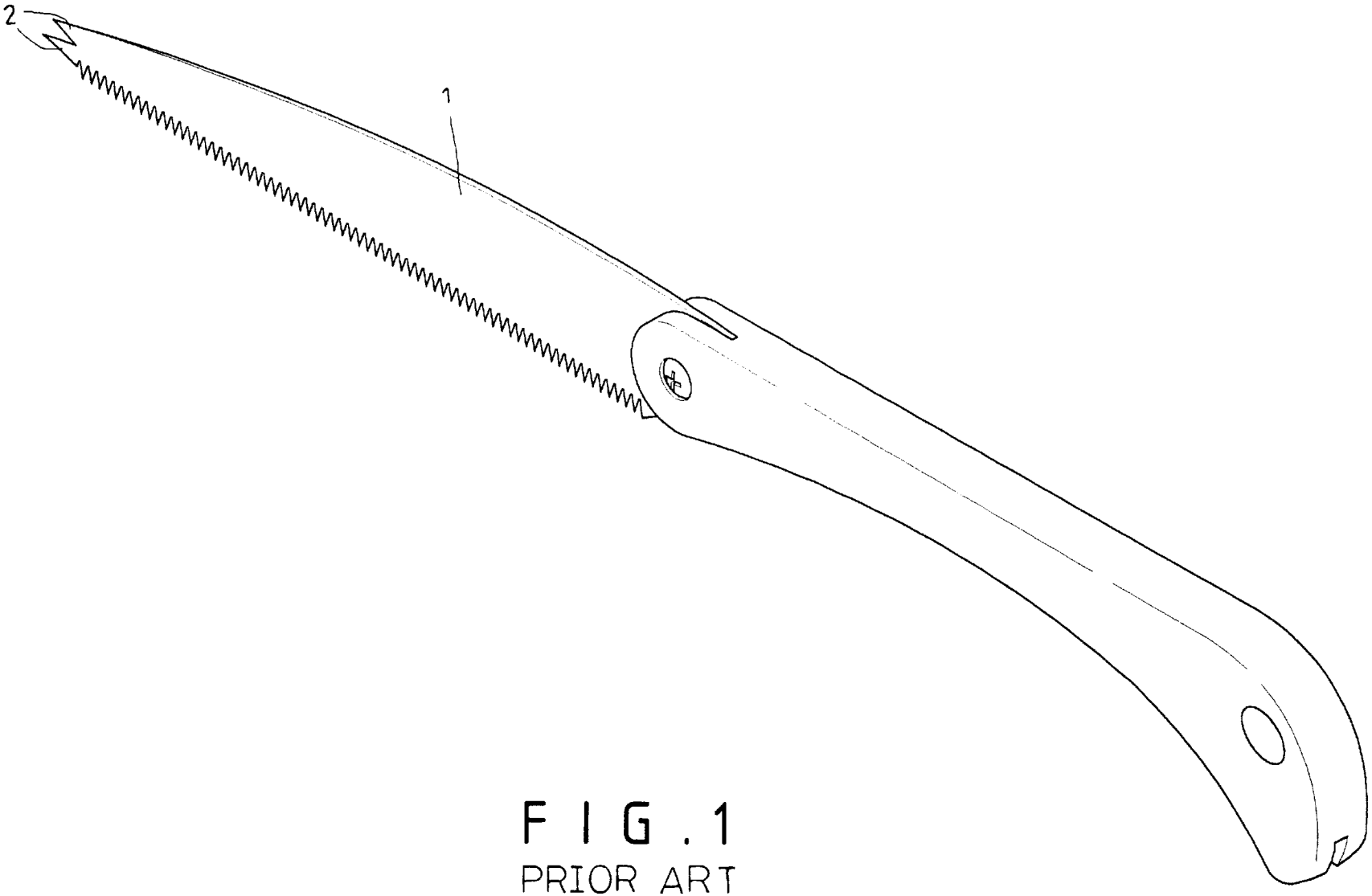
FIG. 1 PRIOR ART
FIG. 1 is a perspective view of a conventional saw of the prior art.
Figure 2:
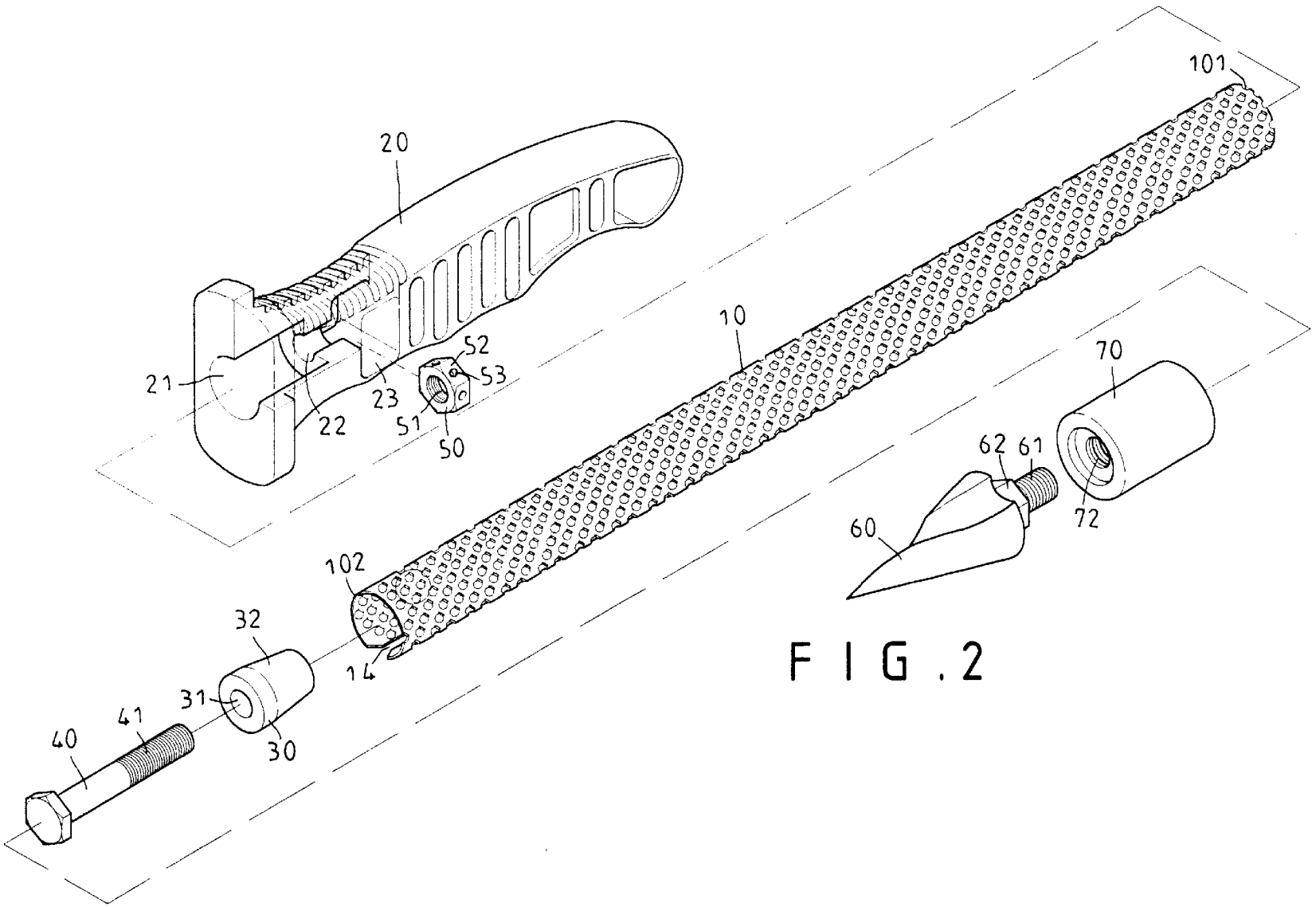
FIG. 2 is a perspective exploded view of a plane saw assembly of a first preferred embodiment in accordance with the present invention.
Figure 2A:
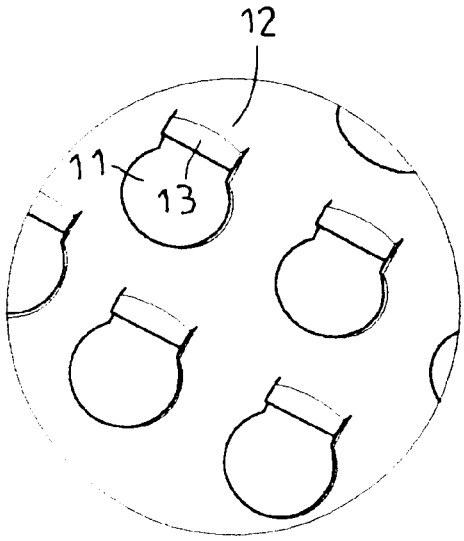
FIG. 2A is a partially enlarged view of a hollow plane saw of a first preferred embodiment in accordance with the present invention.
Figure 2B:
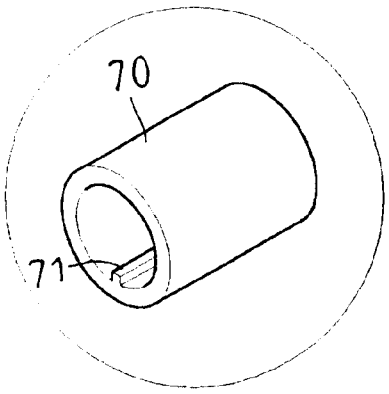
FIG. 2B is a perspective view of a collar of a first preferred embodiment in accordance with the present invention.
Figure 3:
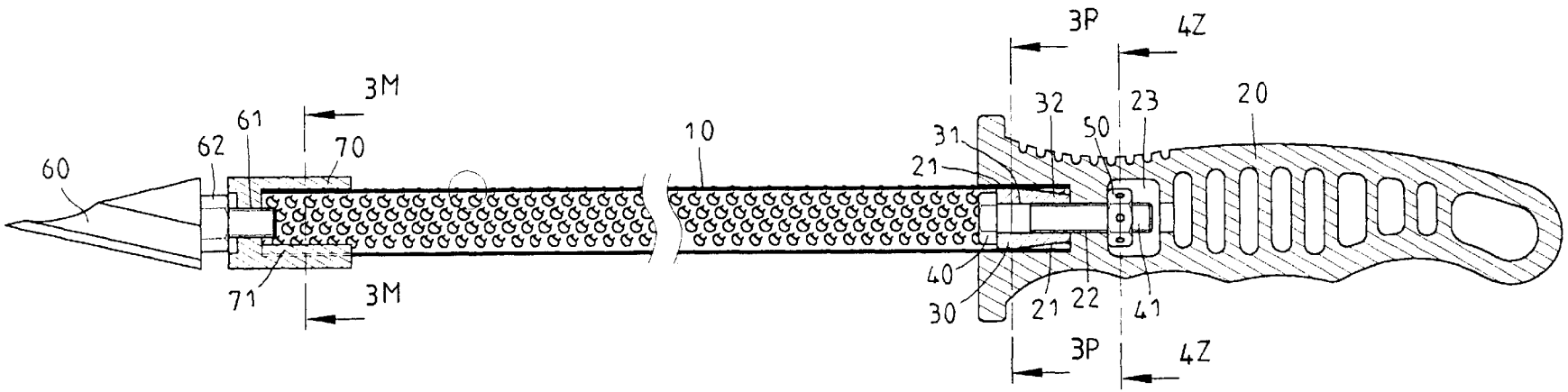
FIG. 3 is a sectional assembly view of a plane saw assembly of a first preferred embodiment in accordance with the present invention.
Figure 3A:
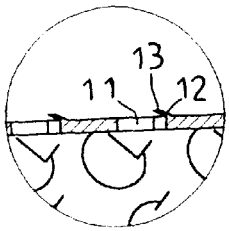
FIG. 3A is a partially sectional enlarged view of a hollow plane saw of a first preferred embodiment in accordance with the present invention.
Figure 3B:
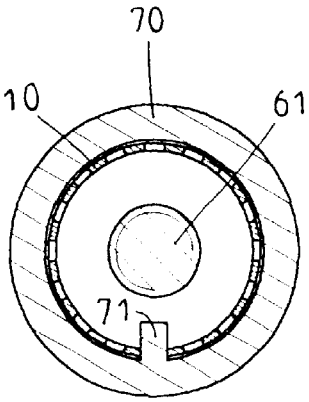
FIG. 3B is a sectional view taken along line 3M—3M in FIG. 3.
Figure 3C:
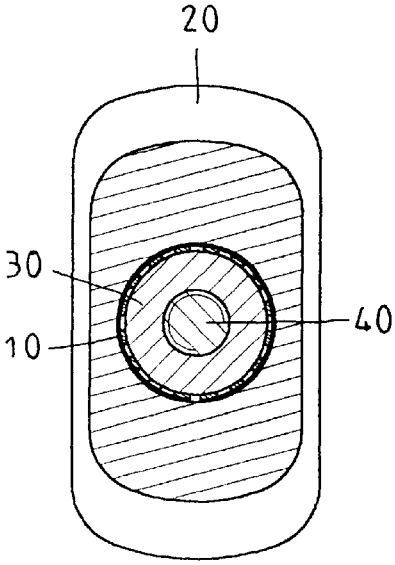
FIG. 3C is a sectional view taken along line 3P—3P in FIG. 3.
Figure 4:
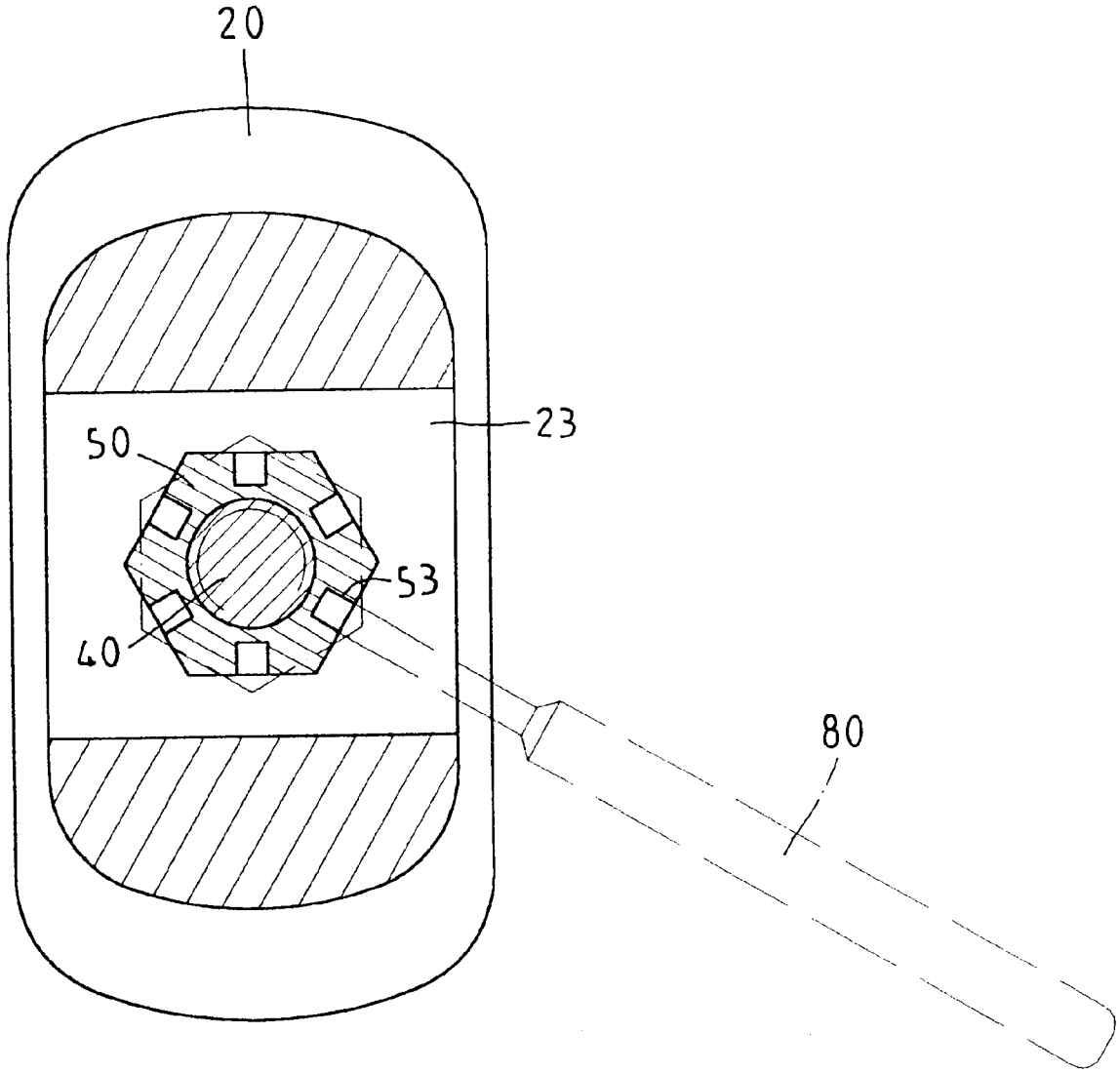
FIG. 4 is a sectional view taken along line 4Z—4Z in FIG. 3.

Referring to FIGS. 2 to 4, a first plane saw assembly comprises a handle 20, a nut 50, a hollow plane saw 10, a hollow plug 30, a bolt 40, a collar 70, and a drill device 62.

The hollow plane saw 10 has a large number of plane blades 12, a large number of through holes 11 communicating with the plane blades 12, a first end 101, a second end 102, and an end slot 14 formed on the second end 102 of the hollow plane saw 10.

Each of the plane blades 12 has a cutting edge 13.

The hollow plane saw 10 is made of a metal plate. The hollow plane saw 10 has a round cross-section.

The handle 20 has an end socket 21 receiving the first end 101 of the hollow plane saw 10, an inner through aperture 22 communicating with the end socket 21, and an inner chamber 23 communicating with the inner through aperture 22.

The nut 50 is inserted in the inner chamber 23. The nut 50 has an inner thread 51, six faces 52 and six round apertures 53 formed on the six faces 52 of the nut 50.

The hollow plug 30 has a center hole 31 and a taper body 32.

The bolt 40 has an outer threaded portion 41.

The collar 70 has a threaded hole 72 and an inner block 71.

The drill device 62 has a bit 60 and a threaded post 61 inserted in the threaded hole 72 of the collar 70.

The hollow plug 30 is inserted in the first end 101 of the hollow plane saw 10.

The bolt 40 is inserted through the hollow plug 30 and the inner through aperture 22 of the handle 20 and engaged with the inner thread 51 of the nut 50.

The second end 102 of the hollow plane saw 10 is inserted in the collar 70.

The inner block 71 is inserted in the end slot 14 of the hollow plane saw 10.

A diameter of the hollow plane saw 10 is larger than a diameter of the end socket 21.

Figure 5:
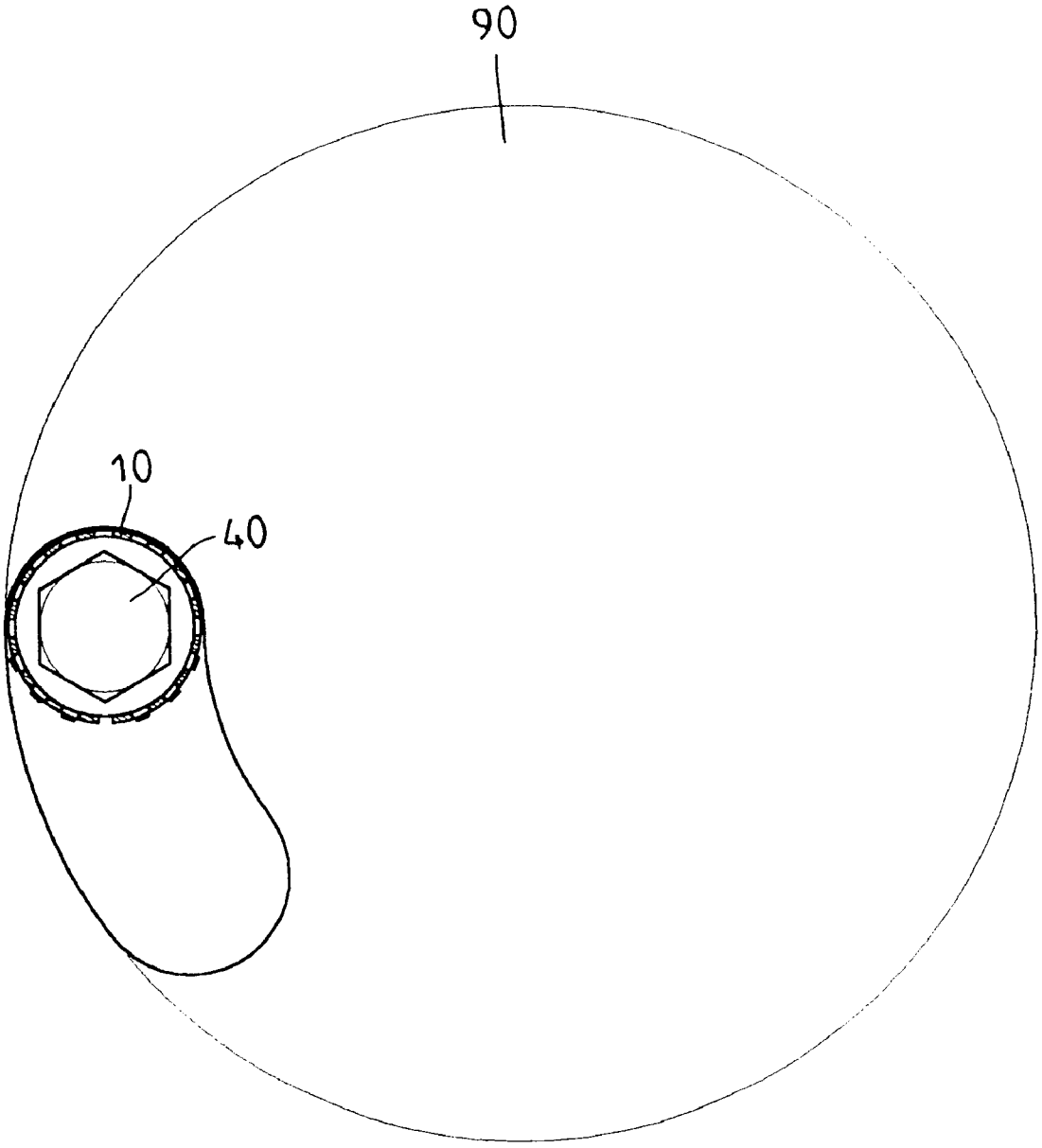
FIG. 5 is a schematic view illustrating a plane saw assembly of a first preferred embodiment inserted in a working article.

Referring to FIG. 5, the bit 60 pierces a hole on a working article 90. Then the hollow plane saw 10 cuts the working article 90 along the hole of the working article 90.

Referring to FIG. 4 again, a rod 80 is inserted in one of the round apertures 53 of the nut 50 in order to tighten or loosen the nut 50.

Figure 6:
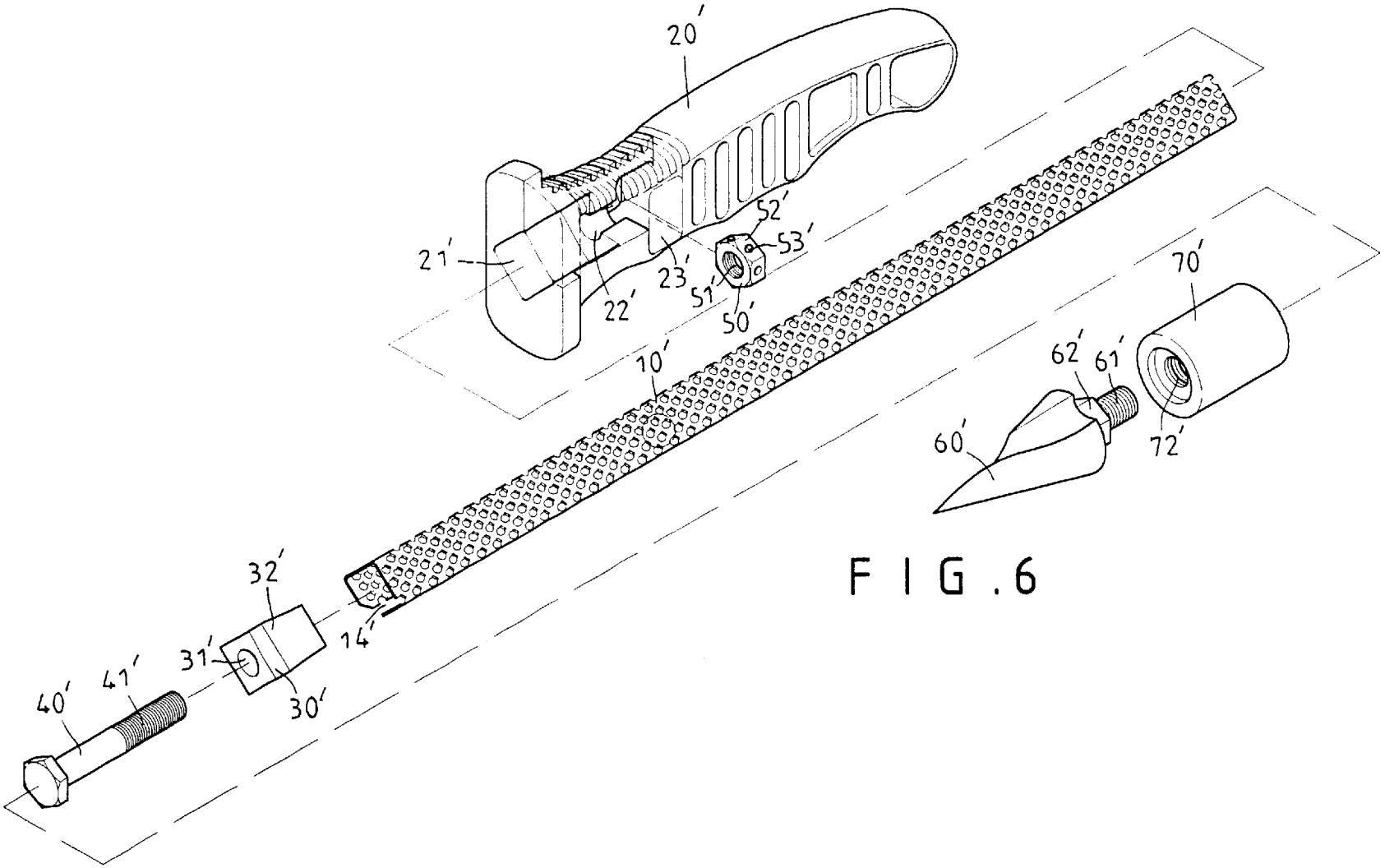
FIG. 6 is a perspective exploded view of a plane saw assembly of a second preferred embodiment in accordance with the present invention.
Figure 6A:
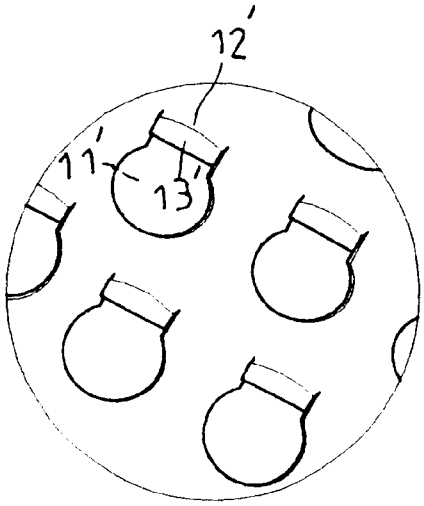
FIG. 6A is a partially enlarged view of a hollow plane saw of a second preferred embodiment in accordance with the present invention.
Figure 6B:
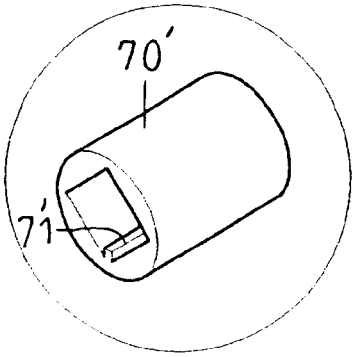
FIG. 6B is a perspective view of a collar of a second preferred embodiment in accordance with the present invention.
Figure 7:
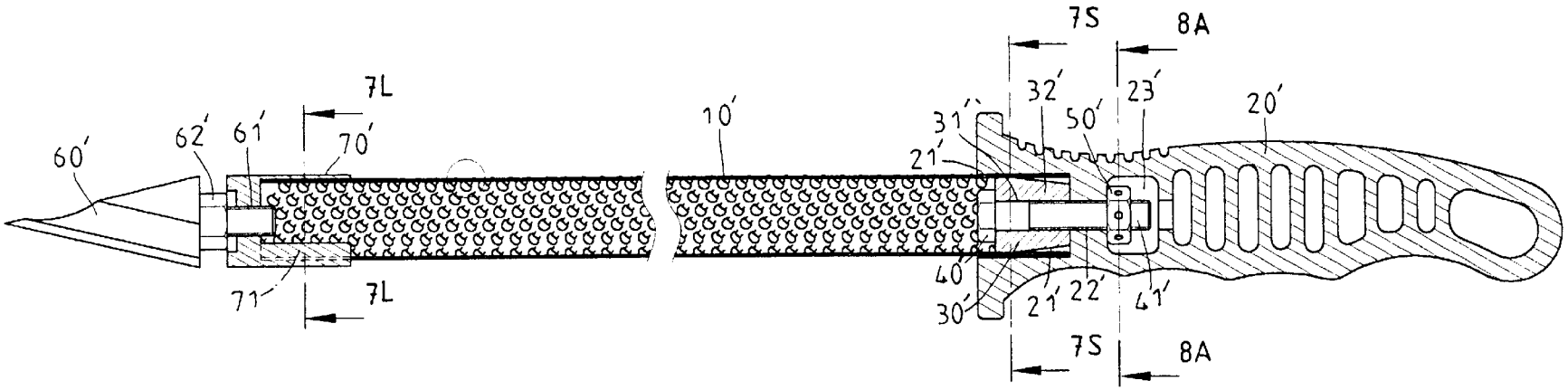
FIG. 7 is a sectional assembly view of a plane saw assembly of a second preferred embodiment in accordance with the present invention.
Figure 7A:
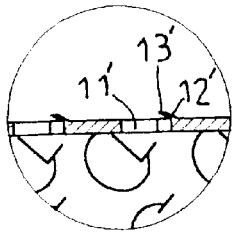
FIG. 7A is a partially sectional enlarged view of a hollow plane saw of a second preferred embodiment in accordance with the present invention.
Figure 7B:
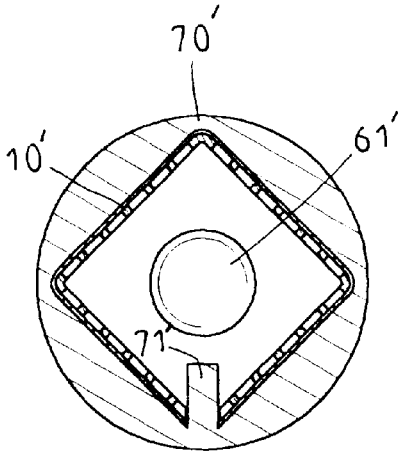
FIG. 7B is a sectional view taken along line 7L—7L in FIG. 7.
Figure 7C:
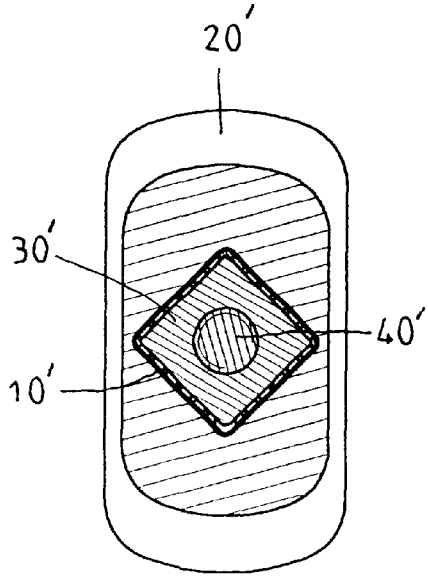
FIG. 7C is a sectional view taken along line 7S—7S in FIG. 7.
Figure 8:
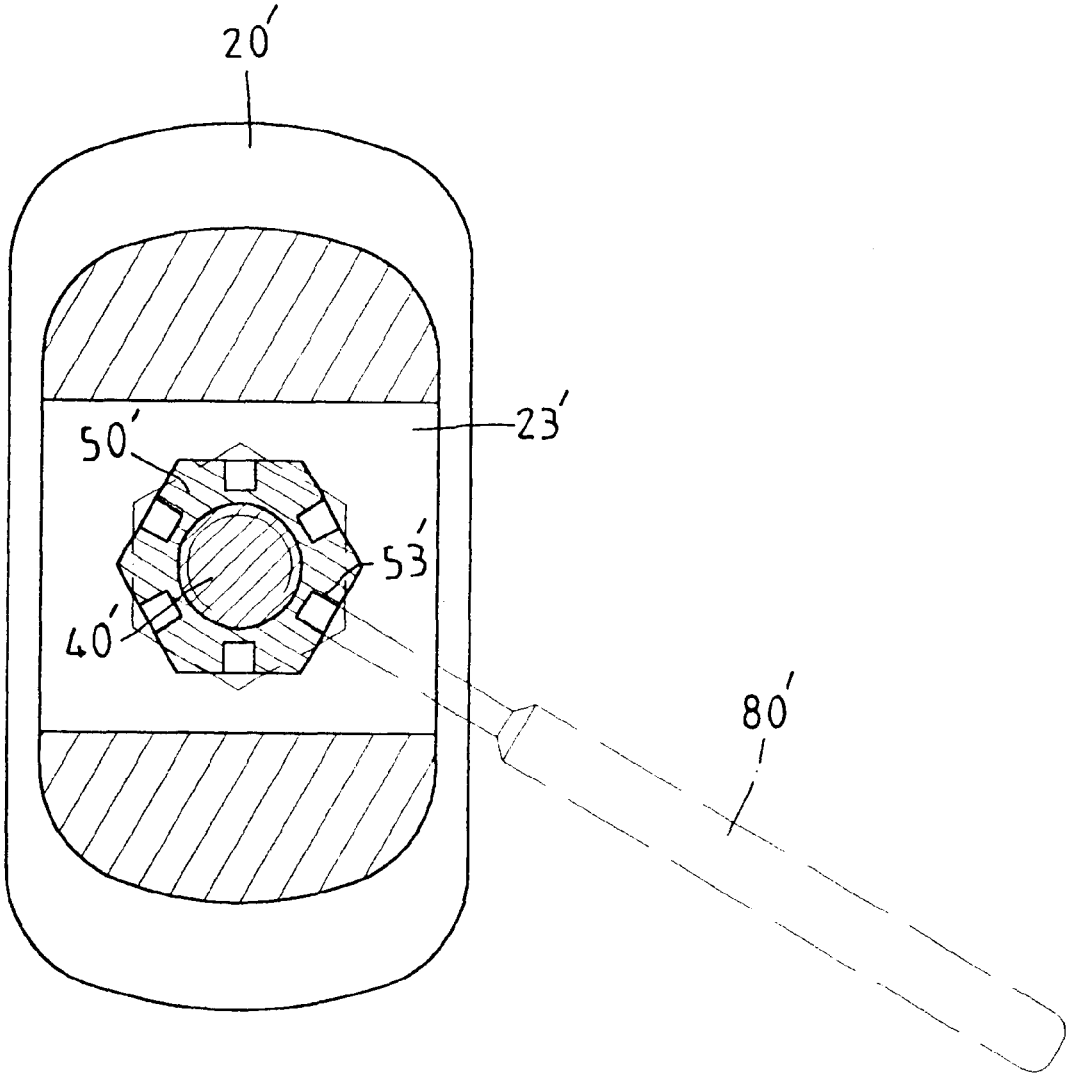
FIG. 8 is a sectional view taken along line 8A—8A in FIG. 7.

Referring to FIGS. 6 to 8, a second plane saw assembly comprises a handle 20', a nut 50', a hollow plane saw 10', a hollow plug 30', a bolt 40', a collar 70', and a drill device 62'.

The hollow plane saw 10' has a large number of plane blades 12', a large number of through holes 11' communicating with the plane blades 12', a first end 101', a second end 102', and an end slot 14' formed on the second end 102' of, the hollow plane saw 10'.

Each of the plane blades 12' has a cutting edge 13'.

The hollow plane saw 10' is made of a metal plate. The hollow plane saw 10' has a square cross-section.

The handle 20' has an end socket 21' receiving the first end 101' of the hollow plane saw 10', an inner through aperture 22' communicating with the end socket 21', and an inner chamber 23' communicating with the inner through aperture 22'.

The nut 50' is inserted in the inner chamber 23'. The nut 50' has an inner thread.51', six faces 521 and six round apertures 53' formed on the six faces 52' of the nut 50'.

The hollow plug 30' has a center hole 31' and a taper body 32'.

The bolt 40' has an outer threaded portion 41'.

The collar 70' has a threaded hole 72' and an inner block 71'.

The drill device 62' has a bit 60' and a threaded post 61' inserted in the threaded hole 72' of the collar 70'.

The hollow plug 30' is inserted in the first end 101' of the hollow plane saw 10'.

The bolt 40' is inserted through the hollow plug 30' and the inner through aperture 22' of the handle 20' and engaged with the inner thread 51' of the nut 50'.

The second end 102' of the hollow plane saw 10' is inserted in the collar 70'.

The inner block 71' is inserted in the end slot 14' of the hollow plane saw 10'.

A diameter of the hollow plane saw 10' is larger than a diameter of the end socket 21'.

Figure 9:
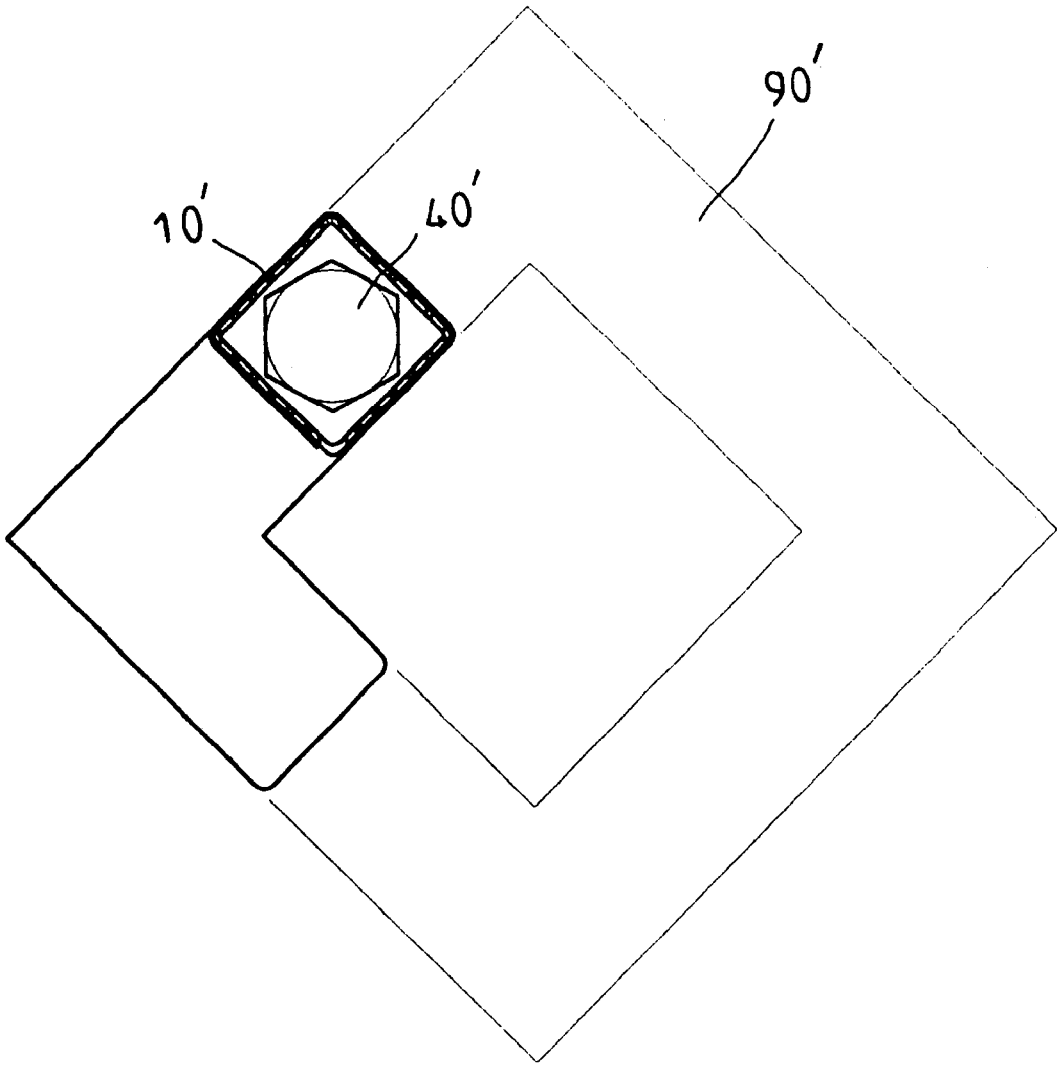
FIG. 9 is a schematic view illustrating a plane saw assembly of a second preferred embodiment inserted in a working article.

Referring to FIG. 9, the bit 60' pierces a hole on a working article 90'. Then the hollow plane saw 10' cuts the working article 90' along the hole of the working article 90'.

Referring to FIG. 8 again, a rod 80' is inserted in one of the round apertures 53' of the nut 50' in order to tighten or loosen the nut 50'.

The present invention is not limited to the above embodiment but various modification thereof may be made. Furthermore, various changes in form and detail may be made without departing from the scope of the present invention.

I claim:

1. A plane saw assembly comprises:

a handle, a nut, a hollow plane saw, a hollow plug, a bolt, a collar, and a drill device, the hollow plane saw having a large number of plane blades, a large number of through holes communicating with the plane blades, a first end, a second end, and an end slot formed on the second end of the hollow plane saw, each of the plane blades having a cutting edge, the handle having an end socket receiving the first end of the hollow plane saw, an inner through aperture communicating with the end socket, and an inner chamber communicating with the inner through aperture, the nut inserted in the inner chamber, The hollow plug having a center hole and a taper body, the bolt having an outer threaded portion, the collar having a threaded hole and an inner block, the drill device having a bit and a threaded post inserted in the threaded hole of the collar, the hollow plug inserted in the first end of the hollow plane saw, the bolt inserted through the hollow plug and the inner through aperture of the handle and engaged with the inner thread of the nut, the second end of the hollow plane saw inserted in the collar, and the inner block inserted in the end slot of the hollow plane saw.

2. The plane saw assembly as claimed in claim 1, wherein the nut has an inner thread, six faces and six round apertures formed on the six faces of the nut.

3. The plane saw assembly as claimed in claim 1, wherein the hollow plane saw has a round cross-section.

4. The plane saw assembly as claimed in claim 1, wherein the hollow plane saw has a square cross-section.

* * * * *